United States Patent [19]

Winger

[11] 4,433,888

[45] Feb. 28, 1984

[54] PRINTED CIRCUIT EDGEBOARD CONNECTOR WITH MULTI-FUNCTION LOCK

[75] Inventor: James L. Winger, Warren, Ohio

[73] Assignee: General Motors Corporation, Detroit, Mich.

[21] Appl. No.: 395,503

[22] Filed: Jul. 6, 1982

[51] Int. Cl.[3] ..... H01R 23/56

[52] U.S. Cl. ..... 339/91 R; 339/75 MP; 339/176 MP; 339/217 S

[58] Field of Search ..... 339/176 MP, 91 R, 217 S, 339/75 MP

[56] References Cited

U.S. PATENT DOCUMENTS

| | | | |
|---|---|---|---|
| 3,737,833 | 6/1973 | Jerominek | 339/91 R |
| 4,066,325 | 1/1978 | Pearce, Jr. et al. | 339/176 MP |
| 4,148,538 | 4/1979 | Rodondi | 339/91 R |
| 4,159,160 | 6/1979 | Plyler et al. | 339/217 S |

FOREIGN PATENT DOCUMENTS

| | | | |
|---|---|---|---|
| 2125858 | 12/1972 | Fed. Rep. of Germany | 339/91 R |

*Primary Examiner*—John McQuade

*Attorney, Agent, or Firm*—F. J. Fodale

[57] ABSTRACT

A printed circuit edgeboard connector is connected to a miniature printed circuit board plug. The edgeboard connector comprises a connector body having two rows of terminals disposed in cavities of the connector body and engaging opposite sides of the printed circuit board. A multi-function lock is inserted into the conductor end of the connector body to prevent withdrawal of the terminals. When attached to the connector body, the multi-function lock has an external flexible lock arm which engages a notch in the printed circuit board to maintain the mechanical connection of the edgeboard connector and the plug.

2 Claims, 6 Drawing Figures

PRINTED CIRCUIT EDGEBOARD CONNECTOR WITH MULTI-FUNCTION LOCK

This invention relates generally to a printed circuit edgeboard connector and, more particularly, to a printed circuit edgeboard connector having a lock means which prevent withdrawal of the terminals from the rows of cavities in the connector body.

U.S. Pat. No. 4,066,325 granted to Warren Pearce, Jr. and Andrew Russo, Jr. on Jan. 3, 1978 discloses a printed circuit edgeboard connector 10 of the above noted type. In this prior art connector, a pair of lock boards or plates 34 are inserted into and retained in lateral slots 32 in the back of the connector body 12. When attached to the connector body 12, the lock plates 34 are disposed behind tabs 76 of the terminals 20 to provide a lock which prevents withdrawal of the terminals 20 from the two rows of cavities 18 in the connector body 12. The prior art edgeboard connector 10 receives the edge portion of a printed circuit board (not shown) in a lateral slot 14 and relies on the frictional fit of the printed circuit board between the two rows of terminal contact tongues 64 to maintain the mechanical connection of the edgeboard connector and the printed circuit board.

The object of this invention is to provide a printed circuit edgeboard connector having a lock means which not only prevents withdrawal of the terminals from the two rows of cavities in the connector body but also provides a positive means for maintaining the mechanical connection of the edgeboard connector and the printed circuit board.

Another object of the invention is to provide a printed circuit edgeboard connector which is particularly useful for connection to a miniature printed circuit board plug.

One feature of the invention is that the printed circuit edgeboard connector has a one-piece multi-function lock which prevents withdrawal of the terminals from both rows of cavities in the edgeboard connector body and also positively locks the edgeboard connector to the printed circuit board.

Another feature of the invention is that the edgeboard connector body and the multi-function lock are separate pieces which can be made of different materials suited to the unique function of each part. For instances, the multi-function lock can be made of a relatively flexible plastic, such as nylon, which is more conducive to the formation of a flexible lock arm for positively locking the connector body to the printed circuit board. On the other hand, the connector body itself can be made of a relatively rigid plastic, such as a glass filled polyester, which provides a good firm support for the terminals against the action of the printed circuit board on the contact tongues but which is not conducive to the formation of a flexible lock arm.

Yet another feature of the invention is that the multi-function lock has a flexible lock arm which overlies a slot in the connector body so that the flexible lock arm can lock onto a protruding portion of the printed circuit board within the length of the edgeboard connector body itself. This invention is thus particularly suited for connection to a miniature circuit board plug.

Still yet another feature of the invention is that the flexible lock arm is external of the edgeboard connector body and, thus, easily accessible for unlocking.

Other objects and features of the invention will become apparent to those skilled in the art as the disclosure is made in the following detailed description of a preferred embodiment of the invention as illustrated in the accompanying sheet of drawing in which.

Figure 1:
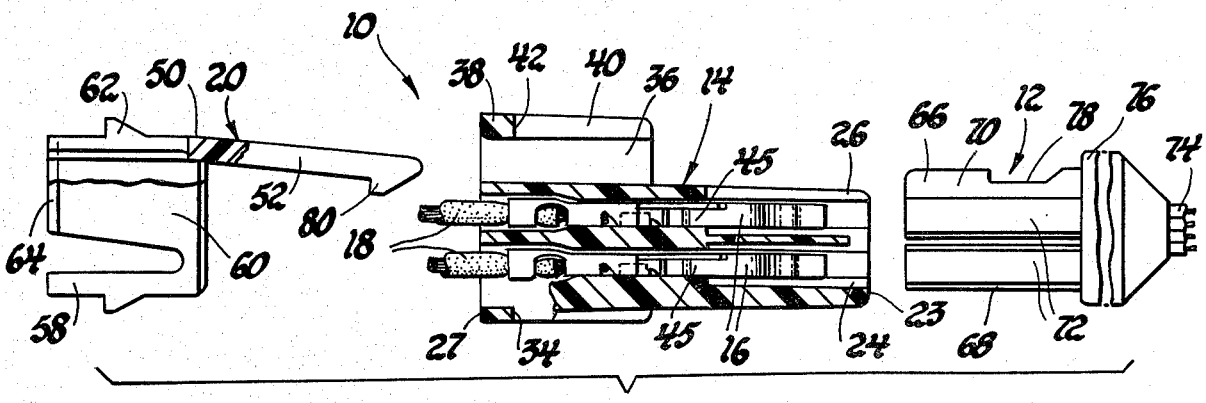
FIG. 1 is an exploded, partially sectioned, longitudinal view of a printed circuit edgeboard connector in accordance with this invention and a cooperating miniature printed circuit board plug.
Figure 6:
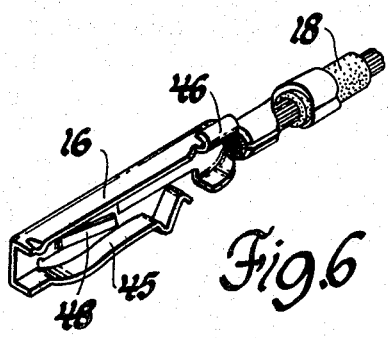
FIG. 6 is a perspective view of a typical terminal.

Referring now to the drawing, the printed circuit edgeboard connector 10 is designed to mate with a miniature printed circuit board plug 12.

The printed circuit edgeboard connector 10, itself, comprises a connector body 14, a plurality of terminals 16 attached to the ends of insulated conductor leads 18 and a multi-function lock 20.

Figure 4:
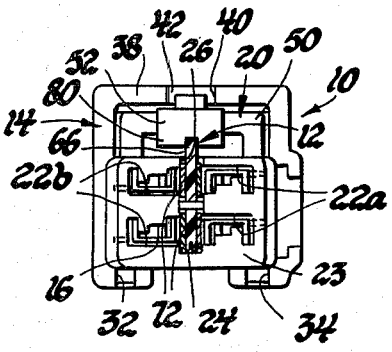
FIG. 4 is a section taken substantially along the line 4—4 of FIG. 2 looking in the direction of the arrows.
Figure 5:
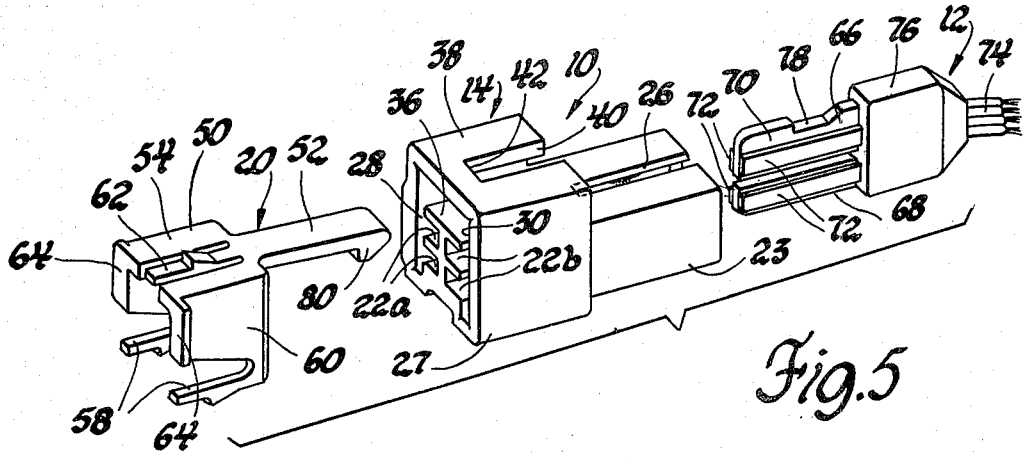
FIG. 5 is an exploded perspective view of the printed circuit edgeboard connector and plug shown in FIG. 1. The terminals and insulated conductor leads are not shown to illustrate internal details of the edgeboard connector body.

The connector body 14 has four terminal cavities *22a,22b* arranged in two rows comprising cavities *22a* and *22b*, respectively, as best shown in FIGS. 4 and 5. The front or socket end 23 of the connector body 14 has a pair of central, laterally aligned slots 24 and 26 disposed between the two rows of terminal cavities *22a,22b* for receiving the two flat prongs of the plug 12. Each slot communicates with a terminal cavity in each row and the lateral slot 26 extends through the side wall of the connector body as shown in FIGS. 1, 2, 4 and 6.

The rear or conductor end 27 of the connector body 14 has two parallel slots 28 and 30 which are at the outer ends of the respective rows of terminal cavities *22a* and *22b* as best shown in FIG. 5. The slot 28 communicates with the rear portions of the cavities *22a* while the slot 30 communicates the rear portions of the cavities *22b*. The slots 28 and 30 extend through the opposite side walls of the connector body 14 to provide two latch shoulders 32 and 34 in one side wall and to communicate with a transverse slot 36 which is outside the other side wall and formed by a shroud 38 at the rear end 27 of the connector body. The shroud 38 has a longitudinal slot 40 which forms a third latch shoulder 42.

Each of the terminal cavities *22a,22b* contain a terminal 16 which is substantially identical to the terminals 20 shown in the aforementioned U.S. Pat. No. 4,066,325 which is incorporated herein by reference where permissible. These terminals have resilient contact tongues 45 which are supported at each end by ribs in the cavities of the connector body 14 in the manner of a simple beam. The terminals 16 also have a rigid tab 46 which is disposed in the slot 28 or 30 when the terminal 16 is initially retained in its respective cavity by a resilient latch tang 48.

The terminals 16 are crimped to the ends of the insulated conductor leads 18 in a conventional manner.

The multi-function lock 20 comprises a U-shaped body 50 and a projecting flexible lock arm 52 integrally attached to the center leg 54 of the U-shaped body. The multi-function lock 20 also has a flexible latch arm 58 at the free end of each side leg 60, a flexible latch arm 62 formed out of the center leg 54 and rear stop flanges 64. The multi-function lock 20 is inserted into the three communicating slots 28, 36 and 30 at the rear end of the connector body 14 and retained by the latch arms 58 and 62 engaging the latch shoulders 32, 34 and 42. The multi-function lock 20 is anchored in the opposite direction by the flanges 64 abutting the conductor end of the connector body 14.

Figure 2:
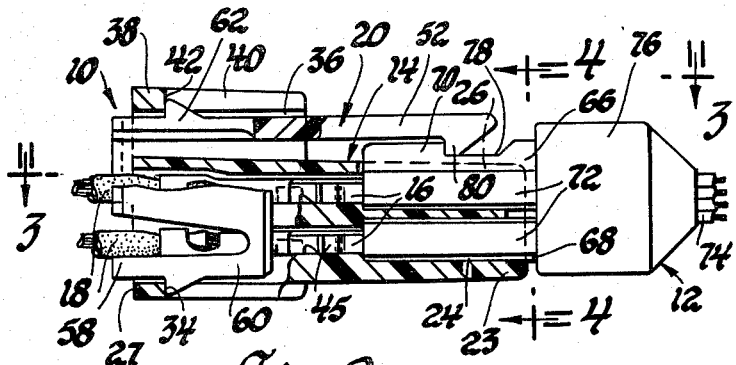
FIG. 2 is a partially section, longitudinal view of the printed circuit edgeboard connector of FIG. 1 shown assembled and connected to the printed circuit board plug.
Figure 3:
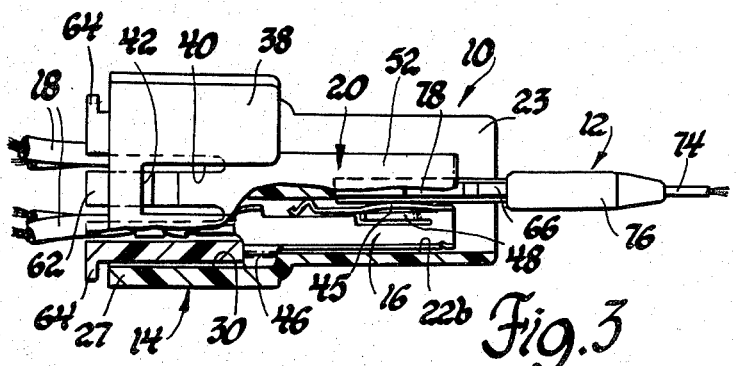
FIG. 3 is a top view taken substantially along the line 3—3 of FIG. 2 looking in the direction of the arrows.

When latched in position, the side legs 60 are disposed in the slot 28 and 30 behind the rigid tabs 46 of the terminals 16 to prevent withdrawal of the terminals 16 through the rear open ends of the cavities **22*a* and 22*b* as shown in FIG. 3. The center leg 54 is disposed in the slot 36 formed by the shroud 38 and the flexible lock arm 52 projects out of the shroud 38 alongside the socket end 23 of the connector body 14 as shown in FIGS. 2 and 3**.

The plug 12 comprises a miniature printed circuit board 66 cut longitudinally to provide two flat prongs 68 and 70 which are received in the laterally aligned slots 24 and 26 in the socket end 23 of the connector body 14. The printed circuit board 66 carries four conductor strips 72—one on each side of each flat prong—as shown in FIG. 5. The rearward portions of the conductor strips 72 are electrically and mechanically connected to a four-way conductor ribbon 74 in any suitable manner. The connections are then molded over to provide a molded connector body 76 for the plug 12.

When the plug 12 is plugged into the edgeboard connector body 14, the flat prong 70 is disposed in the slot 26 and projects outwardly of the side wall of the connector body 14 as shown in FIGS. 2 and 4. The projecting side edge of the flat prong 70 has a notch 78 which receives a nib 80 at the end of the flexible lock arm 52. This positively locks the edgeboard connector body 14 and the plug 12 together. The plug 12 can be unlocked simply by lifting the end of the lock arm 52 which is located externally of the conductor body 14.

It should also be noted that the free ends of the latch arms 58 and 62 project outwardly of the conductor end 27 of the connector body 14 to facilitate the unlatching and removal of the multi-function lock 20.

I wish it to be understood that I do not desire to be limited to the exact details of construction shown and described for obvious modifications will occur to a person skilled in the art.

The embodiments of the invention in which an exclusive property or privilege is claimed are defined as follows:

1. A printed circuit edgeboard connector comprising:

a connector body having two rows of terminal cavities, lateral slot means at one end of the connector body disposed between the two rows of terminal cavities and communicating with the cavities in each row, said lateral slot means extending through a side wall of the connector body, a pair of parallel slots in an opposite end of the connector at the outer ends of the respective rows of terminal cavities, said parallel slots extending through a side wall of the connector body and communicating with a transverse slot outside the side wall formed by a shroud at the opposite end of the connector body, and a multi-function lock comprising a U-shaped body and a flexible lock arm integrally attached to a center leg of the U-shaped body, said multi-function lock being disposed in the parallel and transverse slots so that the flexible lock arm projects out of said shroud alongside the one end of the connector body and overlies the lateral slot means extending through the side wall of the connector body.

2. A printed circuit edgeboard connector comprising:

a connector body having two rows of terminal cavities, a plurality of central, laterally aligned slots at one end of the connector body disposed between the rows of terminal cavities and communicating with a cavity in each row, one of said laterally aligned slots extending through a side wall of the connector body, a pair of parallel slots in an opposite end of the connector at the outer ends of the respective rows of terminal cavities, said parallel slots forming latch shoulders at one side wall of the connector body and extending through an opposite side wall of the connector body to communicate with a transverse slot outside the opposite side wall formed by a shroud at the opposite end of the connector body, said shroud having a latch shoulder therein, and a multi-function lock comprising a U-shaped body, and a flexible lock arm which is integrally attached to a center leg of the U-shaped body and has a nib at a free end thereof, said multi-function lock being disposed in the parallel and transverse slots so that the flexible lock arm projects out of said shroud alongside the one end of the connector body and the nib at the free end thereof overlies the laterally aligned slot extending through the side wall of the connector body, and means for retaining the multi-function lock in assembly with the connector body comprising a latch arm associated with each leg of the U-shaped body which cooperates with one of the latch shoulders of the connector body.

* * * * *